US009417556B2

(12) United States Patent
Suzuki et al.

(10) Patent No.: US 9,417,556 B2
(45) Date of Patent: Aug. 16, 2016

(54) CARTRIDGE AND IMAGE FORMING APPARATUS

(71) Applicant: CANON KABUSHIKI KAISHA, Tokyo (JP)

(72) Inventors: Akira Suzuki, Naka-gun (JP); Hiroomi Matsuzaki, Mishima (JP); Shogo Satomura, Kawasaki (JP); Tetsuo Uesugi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/717,683

(22) Filed: May 20, 2015

(65) Prior Publication Data

US 2015/0338772 A1 Nov. 26, 2015

(30) Foreign Application Priority Data

May 23, 2014 (JP) ..... 2014-107445

(51) Int. Cl.

| | |
|---|---|
| ***G03G 15/08*** | (2006.01) |
| ***G03G 21/00*** | (2006.01) |
| ***G03G 21/18*** | (2006.01) |
| *G03G 15/00* | (2006.01) |
| *G03G 15/20* | (2006.01) |

(52) U.S. Cl.

CPC ..... *G03G 15/0812* (2013.01); *G03G 15/08* (2013.01); *G03G 15/0894* (2013.01); *G03G 21/00* (2013.01); *G03G 21/18* (2013.01); *G03G 15/2003* (2013.01); *G03G 15/2064* (2013.01); *G03G 15/2078* (2013.01); *G03G 15/5004* (2013.01); *Y10T 29/49828* (2015.01)

(58) Field of Classification Search

CPC ..... G03G 15/20
USPC ..... 399/34, 35, 70, 350
See application file for complete search history.

(56) References Cited

U.S. PATENT DOCUMENTS

| | | | | | |
|---|---|---|---|---|---|
| 5,809,374 | A * | 9/1998 | Tsuda | G03G 21/1832 | 399/102 |
| 5,966,567 | A * | 10/1999 | Matsuzaki | G03G 21/1825 | 399/111 |
| 6,137,970 | A * | 10/2000 | Sasago | G03G 21/1832 | 399/106 |
| 6,154,623 | A * | 11/2000 | Suzuki | G03G 21/1846 | 399/111 |
| 6,205,304 | B1 * | 3/2001 | Kawaguchi | G03G 15/0817 | 399/103 |
| 6,219,504 | B1 * | 4/2001 | Matsuzaki | G03G 21/1814 | 399/111 |
| 6,266,502 | B1 * | 7/2001 | Matsuzaki | G03G 21/007 | 220/653 |

(Continued)

FOREIGN PATENT DOCUMENTS

| | | | | |
|---|---|---|---|---|
| JP | 2000-132039 | * | 5/2000 | G03G 15/20 |
| JP | 2000-132039 | A | 5/2000 | |

*Primary Examiner* — Clayton E LaBalle
*Assistant Examiner* — Kevin Butler
(74) *Attorney, Agent, or Firm* — Canon USA, Inc., IP Division

(57) ABSTRACT

A cartridge includes a rotating body, a blade that extends in an axial direction of the rotating body and is disposed on the rotating body, a supporting member that is fixed to the blade and configured to support the blade in such a manner that the blade protrudes toward the rotating body in a shorter direction crossing the axial direction, a frame body including a placing surface that supports the supporting member, and a fixed portion that is disposed on the placing surface via the supporting member and fixed to the frame body. The supporting member includes a cut portion extending in the axial direction. The fixed portion includes a deformed portion deformed by given energy, and the deformed portion engages with the cut portion so that movement of the supporting member with respect to the frame body is restricted.

18 Claims, 7 Drawing Sheets

(56) References Cited

U.S. PATENT DOCUMENTS 7,099,607 B2 * 8/2006 Suzuki ..... B29C 65/548 222/DIG. 1
7,142,795 B2 * 11/2006 Sugiyama ..... H04N 1/2112 399/111
8,233,821 B2 * 7/2012 Miyabe ..... G03G 21/186 399/109
2003/0113131 A1 * 6/2003 Watanabe ..... B29C 45/14467 399/111
2010/0150604 A1 * 6/2010 Hayashida ..... G03G 21/1828 399/105
2013/0164029 A1 * 6/2013 Fukui ..... G03G 21/1647 399/111
2013/0216287 A1 * 8/2013 Inami ..... G03G 15/095 399/351
2014/0212166 A1 * 7/2014 Takeuchi ..... G03G 15/0898 399/106
2015/0093146 A1 * 4/2015 Sato ..... G03G 21/1825 399/111

* cited by examiner

CARTRIDGE AND IMAGE FORMING APPARATUS

BACKGROUND OF THE INVENTION

1. Field of the Invention

The present invention relates to an image forming apparatus and a cartridge that can be detachably attached to a main body of the image forming apparatus.

2. Description of the Related Art

The present invention relates to an electrophotographic image forming apparatus and a cartridge that can be detachably attached to the electrophotographic image forming apparatus. The electrophotographic image forming apparatus (hereinafter, referred to as an image forming apparatus) forms an image on a recording material (a recording medium) through an electrophotographic image forming process. Examples of the image forming apparatus include a printer (a laser beam printer, a light emitting diode (LED) printer, and the like), a copying machine, a facsimile apparatus, a word processor, a multifunction peripheral (multifunction printer) having the functions of these.

Conventional image forming apparatuses that perform the electrophotographic image forming process employ a process cartridge system, in which a cartridge is detachably attached to a main body of the image forming apparatus. The process cartridge system employs a cartridge formed by integrating an electrophotographic photosensitive drum (hereinafter, referred to as a photosensitive drum) and a process unit that processes the photosensitive drum, and thus can facilitate maintenance of the image forming apparatus.

Japanese Patent Application Laid-Open No. 2000-132039 discusses this type of cartridge. In the cartridge, a toner frame including a toner container that contains toner is coupled to a developer frame that holds a developing unit such as a developing roller. The image forming apparatus has a configuration in which a fixing unit is disposed following a cleaning unit. Accordingly, a cleaning frame is deformed by heat of the fixing unit. Thus, a configuration has been proposed, in which sheet metals as reinforcement members are fixed to both ends within the cleaning frame with small screws, whereby thermal deformation of a portion mounted with a cleaning blade, which is especially important in the cleaning, is prevented. Furthermore, Japanese Patent Application Laid-Open No. 2000-132039 proposes a configuration in which the cleaning frame made of resin is locked with a sheet metal or a cleaning blade sheet metal using a small screw via a resin washer, so that the cleaning frame and the sheet metal can slightly slide, when the temperature of the cleaning unit rises.

SUMMARY OF THE INVENTION

A cartridge according to the present invention includes a rotating body, a blade that extends in an axial direction of the rotating body and is disposed on the rotating body, a supporting member that is fixed to the blade and configured to support the blade in such a manner that the blade protrudes toward the rotating body in a shorter direction crossing the axial direction, a frame body including a placing surface that supports the supporting member, and a fixed portion that is disposed on the placing surface via the supporting member and fixed to the frame body. In the cartridge according to the present invention, the supporting member includes a cut portion extending in the axial direction, the fixed portion includes a deformed portion deformed by given energy, and the deformed portion engages with the cut portion so that movement of the supporting member with respect to the frame body is restricted.

A method for manufacturing a cartridge according to the present invention relates to a cartridge including a rotating body, a blade that extends in an axial direction of the rotating body and is disposed on the rotating body, a supporting member that is fixed to the blade and configured to support the blade in such a manner that the blade protrudes toward the rotating body in a shorter direction crossing the axial direction, a frame body including a placing surface that supports the supporting member, and a fixed portion that is disposed on the placing surface via the supporting member and fixed to the frame body. The method for manufacturing the cartridge according to the present invention includes fixing the fixed portion to the frame body with the fixed portion disposed on the supporting member, and forming a deformed portion by applying energy to the fixed portion after the fixing so that the fixed portion is deformed and engaging the deformed portion with a cut portion which is included in the supporting member and extending in the axial direction so that movement of the supporting member with respect to the frame body is restricted.

Further features of the present invention will become apparent from the following description of exemplary embodiments (with reference to the attached drawings).

DESCRIPTION OF THE EMBODIMENTS

Exemplary embodiments of the present invention are described below in detail based on the drawings.

In the description below, a longitudinal direction N is an axial direction of a developer bearing member, that is, a developing roller, and an image bearing member, that is, a photosensitive drum.

[Schematic Overall Configuration of Image Forming Apparatus]

<Overall Configuration of Image Forming Apparatus>

Figure 2:
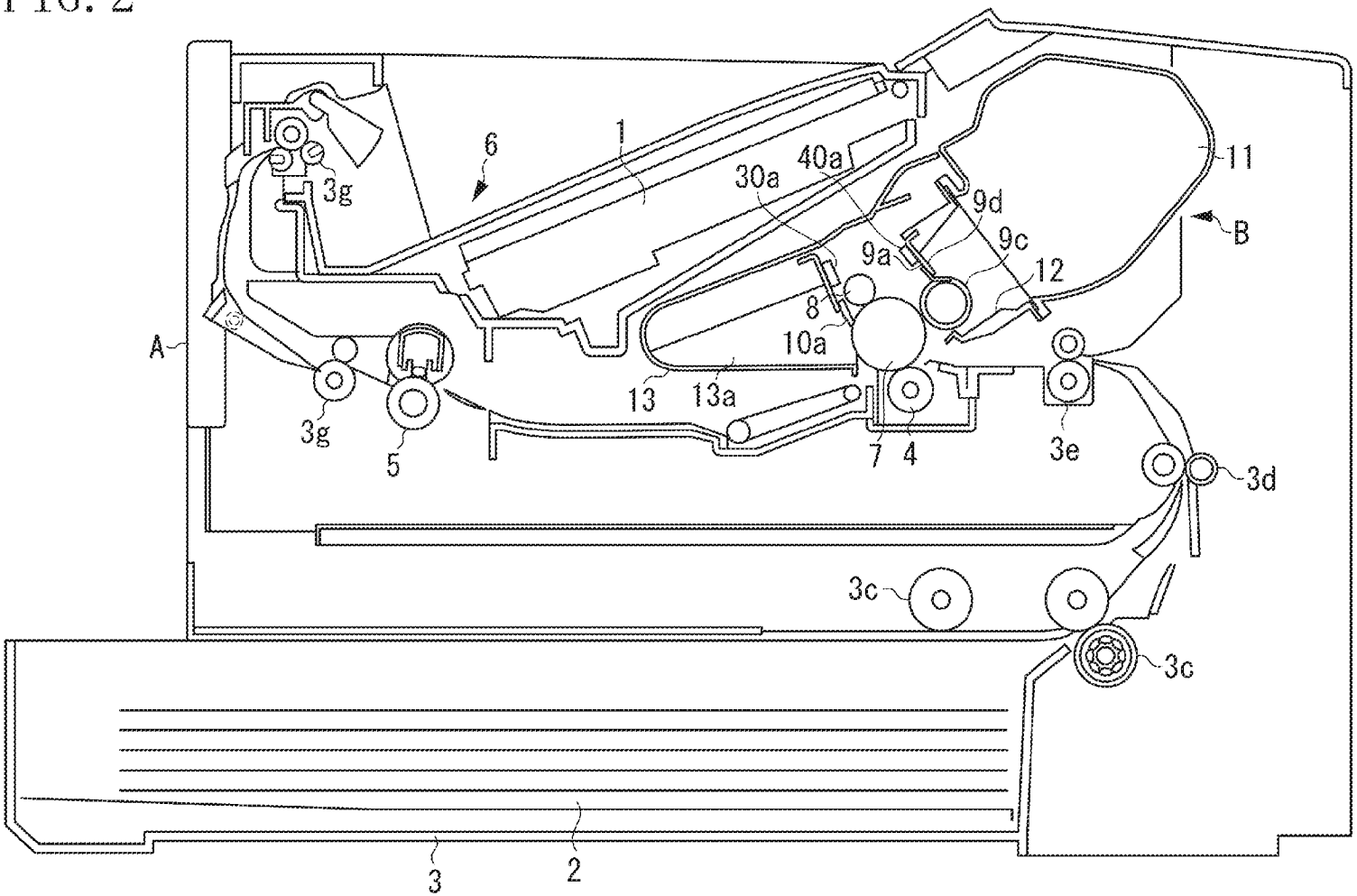
FIG. 2 is a cross-sectional view of an image forming apparatus according to exemplary embodiments.

A first exemplary embodiment of the present invention is described below. First of all, an overall schematic configuration of a main body A of an image forming apparatus (hereinafter, referred to as a main body) is described with reference to FIG. 2. As illustrated in FIG. 2, a process cartridge B is detachably attached to the main body A. Here, the process cartridge includes a photosensitive drum and at least a developing unit as a process unit that processes the photosensitive drum. The photosensitive drum and the developing unit are integrally formed as a cartridge detachably attached to the main body of the image forming apparatus.

The cartridge B includes process units that are integrally formed. The process units include a rotatable photosensitive drum 7, a charging roller 8 on a circumference of the photosensitive drum 7, a developing roller 9*c*, a developer blade 9*d*, a cleaning blade 10*a*, and the like. The charging roller 8 uniformly charges the surface of the photosensitive drum 7. The developer blade 9*d* maintains a constant thickness of toner attached to the developing roller 9*c*. The developing roller 9*c* develops a latent image formed on the photosensitive drum 7 with toner so that the latent image is visualized. The cleaning blade 10*a* removes toner remaining on the photosensitive drum 7, after a toner image formed on the photosensitive drum 7 is transferred onto a recording medium. An exposure device 1 is disposed above the cartridge B. The exposure device 1 selectively exposes the photosensitive drum 7 to light based on image information, so that the latent image is formed on the photosensitive drum 7.

A cassette 3 accommodating a recording medium 2 which is, for example, a sheet of paper, is installed in a lower portion of the main body A. A recording medium conveyance unit is disposed in such a manner that the recording medium 2 passes through a transfer roller 4 and a fixing device 5 and is conveyed to an upper portion of the main body A. More specifically, feed rollers 3*c*, a pair of conveyance rollers 3*d*, and a pair of registration rollers 3*e* are disposed in the main body A. The feed rollers 3*c* separate and feed the recording media 2 stored in the cassette 3 one by one. The pair of conveyance rollers 3*d* conveys the fed recording medium 2. The pair of registration rollers 3*e* synchronizes the timings of the latent image formed on the photosensitive drum 7 and the recording medium 2. The fixing device 5 fixes the image formed on the recording medium 2.

An image is formed as follows. The photosensitive drum 7 is rotated, and the exposure device 1 selectively exposes to light the photosensitive drum 7 which is uniformly charged by the charging roller 8. Thus, an electrostatic latent image is formed on the photosensitive drum 7. The latent image is developed by the developing roller 9*c*. With this, the toner image is formed on the photosensitive drum 7. The pair of registration rollers 3*e* conveys the recording medium 2 to a portion between the photosensitive drum 7 and the transfer roller 4 in synchronization with the image forming. Then, voltage is applied to the transfer roller 4, whereby the toner image is transferred onto the recording medium 2. Thus, the image is formed on the recording medium 2. The recording medium 2 on which the image has been formed is heated and pressed by the fixing device 5, whereby the toner image is fixed. Then, the recording medium 2 is discharged onto a discharge portion 6 by a discharge roller 3*g*.

<Overall Schematic Configuration of Cartridge>

Figure 3:
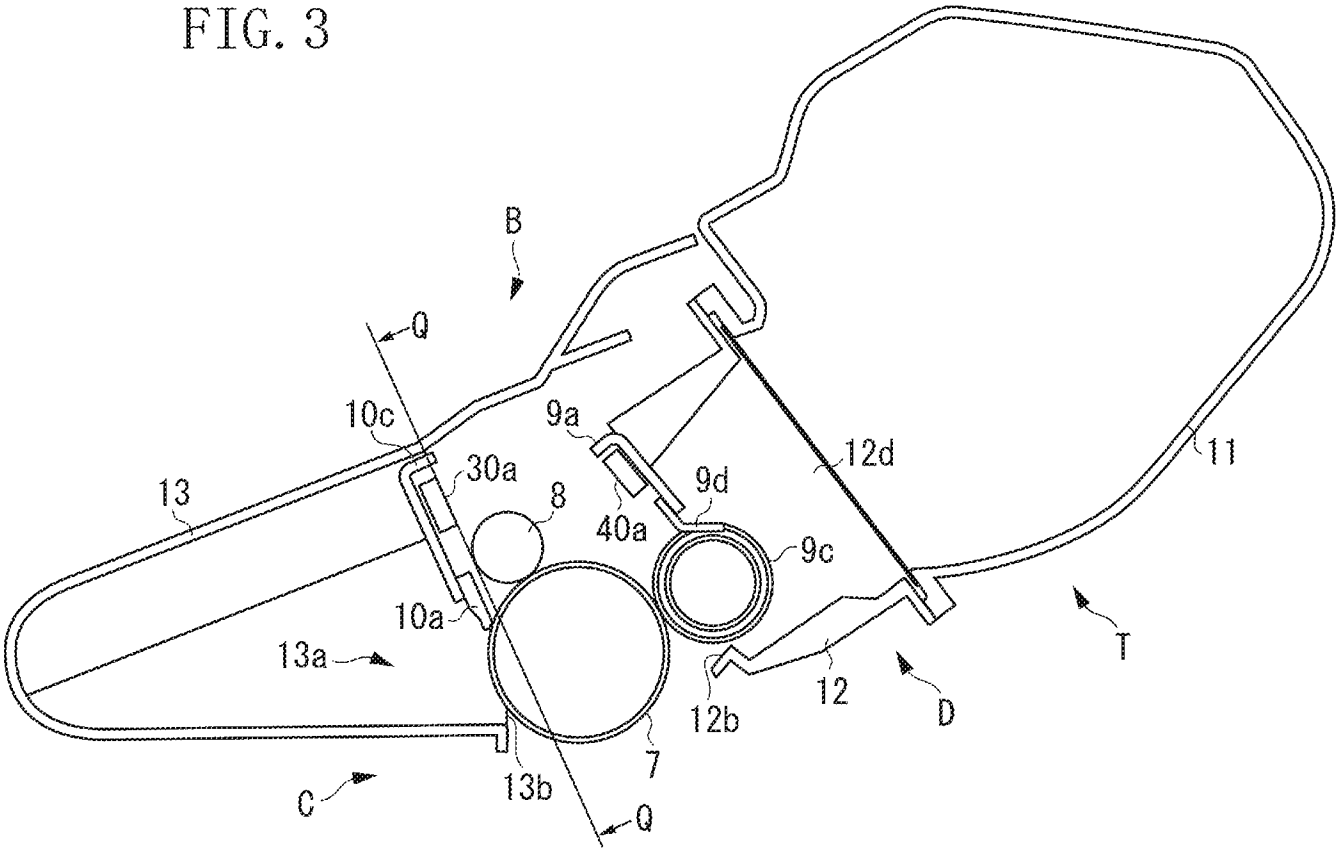
FIG. 3 is a cross-sectional view of a cartridge according to the exemplary embodiments.

Now, an overall schematic configuration of the cartridge B is described with reference to FIG. 3. FIG. 3 is a cross-sectional view of the cartridge B containing toner.

The cartridge B includes a cleaning unit C and a developer unit T. The cleaning unit C includes the photosensitive drum 7, the charging roller 8, the cleaning blade 10*a*, a scoop sheet 13*b*, and a cleaning container 13 forming a waste toner chamber 13*a*. The charging roller 8, the cleaning blade 10*a*, and the scoop sheet 13*b* are disposed on the circumference of the photosensitive drum 7 as a rotating body. The cleaning blade 10*a* is made of an elastic member such as rubber, and is fixed to the cleaning container 13 via a first supporting member 10*c* supported by a first fixed portion 30*a*. The cleaning blade 10*a* is in contact with the photosensitive drum 7 being inclined in a rotation direction of the photosensitive drum 7 from a normal line of the photosensitive drum 7. Remaining toner that has been removed from the surface of the photosensitive drum 7 by the cleaning blade 10*a* drops onto the waste toner chamber 13*a*. The scoop sheet 13*b* is in contact with the photosensitive drum 7 to prevent the waste toner in the waste toner chamber 13*a* from leaking. The photosensitive drum 7 is driven to rotate according to the image forming operation by the driving force transmitted from the main body A to the cleaning unit C. The charging roller 8, rotatably attached to the cleaning unit C, is pressed toward the photosensitive drum 7, and thus is driven by the photosensitive drum 7 to rotate.

The developer unit T includes a developing unit D and a toner container 11 that contains toner supplied to an opening 12*d* of a developer container 12 of the developing unit D. The developing unit D includes the developing roller 9*c*, the developer blade 9*d*, a blowout prevention sheet 12*b*, and the developer container 12. The developing roller 9*c* rotates while being in contact with the photosensitive drum 7. The developer blade 9*d* regulates the thickness of a toner layer on the developing roller 9*c*. The developer container 12 supports the developing roller 9*c*. The developer blade 9*d* and the blowout prevention sheet 12*b* are disposed on a circumference of the developing roller 9*c* which is a rotating body. The developer blade 9*d* is formed of an elastic member such as rubber, and is fixed to the developer container 12 via a second supporting member 9*a* supported by the second fixed portion 40*a*. The blowout prevention sheet 12*b* is provided in the developer container 12 and is in contact with the developing roller 9*c* to prevent the toner from leaking from the developer container 12. The developer unit T is fixed to the cleaning unit C in such a manner that the developing roller 9*c* and the photosensitive drum 7 face each other.

<Detailed Description of Cleaning Unit>

Figure 1:
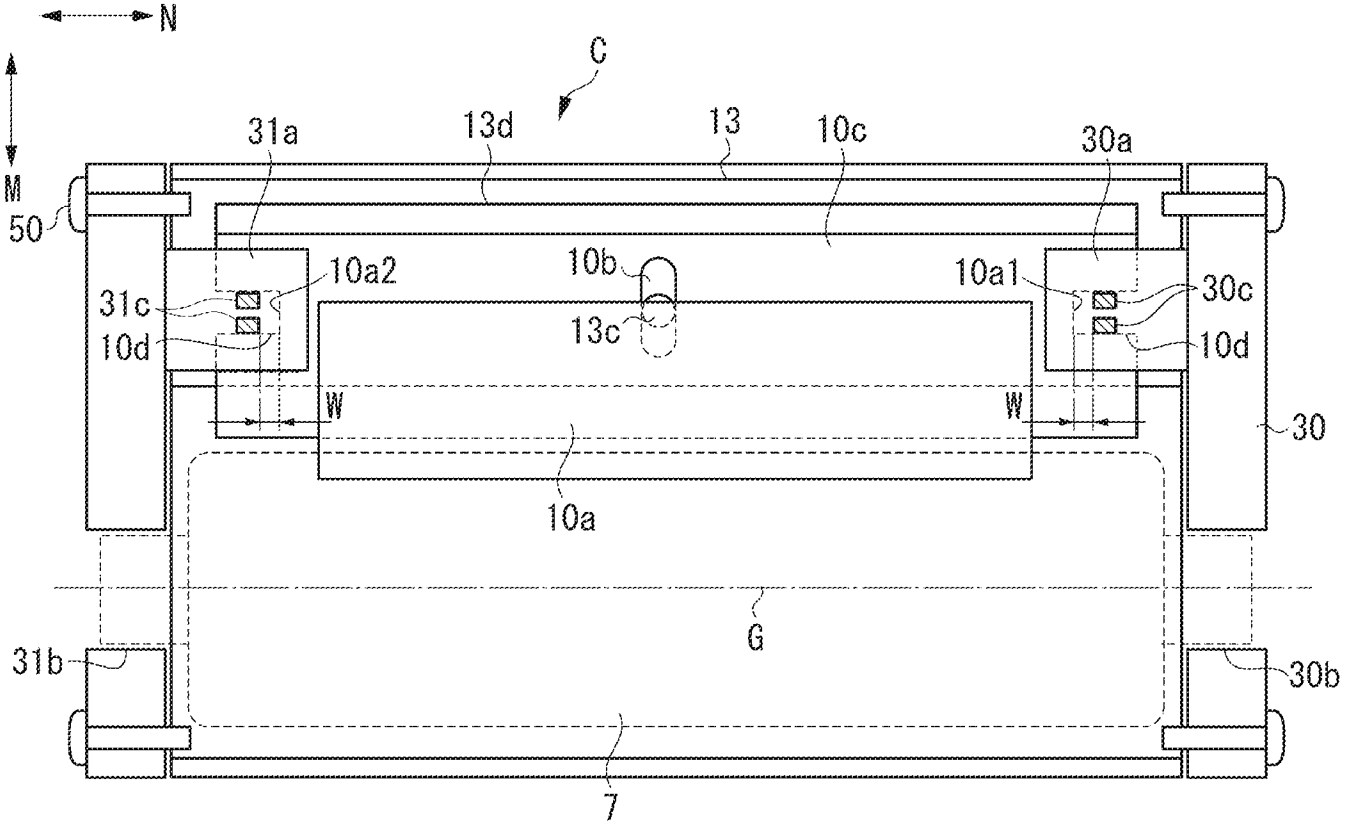
FIG. 1 is a cross-sectional view of a cartridge according to a first exemplary embodiment.

FIG. 1 is a schematic view of the cleaning unit C taken along a line Q-Q in FIG. 3. In the cleaning container 13 which is a frame body, an opening leading to the waste toner chamber 13*a* is formed, and a first placement surface 13*d* is disposed adjacent to the opening. The first supporting member 10*c* includes first cut portions 10*a*1 and 10*a*2 and a first engagement portion 10*b*. The first cut portions 10*a*1 and 10*a*2 are respectively disposed at both ends of the first supporting member 10*c* in the longitudinal direction N. The first cut portions 10*a*1 and 10*a*2 each have two parallel sides along the longitudinal direction N, and are disposed to have a shape that extends in the longitudinal direction N. The first engagement portion 10*b* is disposed substantially at the center of the first supporting member 10*c* in the longitudinal direction N. The first engagement portion 10*b* has two parallel sides along a shorter direction M crossing the longitudinal direction N, and is disposed to have a shape that extends in the shorter direction M.

The first supporting member 10*c* is placed on the first placing surface 13*d* of the cleaning container 13 in an engaged state where the first engaged portion 13*c* is inserted in the first engagement portion 10*b*. Thus, the first supporting member 10*c* and the cleaning container 13 are positioned in the longitudinal direction N. The first engagement portion 10*b* may be an elongated hole as in FIG. 1, or may be an opening at one end in the shorter direction M, which does not face the photosensitive drum 7. According to the present exemplary embodiment, a configuration is employed where the first engaged portion 13*c* as a protrusion and the first engagement portion 10*b* as a recess are used. However, it should not be limited to the configuration. Any configuration can be employed as long as the first engaged portion 13*c* and the first engagement portion 10*b* can be positioned in the longitudinal direction N. For example, the first engaged portion 13*c* as a recess and the first engagement portion 10*b* as a protrusion may be used. The cleaning blade 10*a* is fixed to the first supporting member 10*c* in such a manner as to extend from one end in the shorter direction M facing the opening toward the rotating body, that is, the cleaning blade 10*a* is fixed toward the photosensitive drum 7, along the longitudinal direction N. The cleaning blade 10*a* and the first supporting member 10*c* are integrally formed by molding or welding.

First bearing members 30 and 31 including first fixed portions 30*a* and 31*a* and first bearings 30*b* and 31*b* are fixed to ends of the cleaning container 13 in the longitudinal direction N, with screws 50. Thus, a shaft of the photosensitive drum 7 is supported by the first bearings 30*b* and 31*b* in such a manner that the photosensitive drum 7 comes into contact with the cleaning blade 10*a* above the opening of the cleaning container 13. The first fixed portions 30*a* and 31*a* are disposed to cover the first cut portions 10*a*1 and 10*a*2 of the first supporting member 10*c*. More specifically, the first supporting member 10*c* is fixed by sandwiching between the cleaning container 13 and the first fixed portions 30*a* and 31*a*. The first fixed portions 30*a* and 31*a* include first deformed portions 30*c* and 31*c*, which are formed in the first cut portions 10*a*1 and 10*a*2 of the first supporting member 10*c*. It is desirable that at least one of the first deformed portions 30*c* and 31*c* is disposed to come into contact with both two parallel sides along the longitudinal direction N, of a corresponding one of the first cut portions 10*a*1 and 10*a*2. The first deformed portions 30*c* and 31*c* having a tapered cross-sectional shape are formed to come into contact with inner wall surfaces 10*d* of the first cut portions 10*a*1 and 10*a*2. The inner wall surface 10*d* extends in a thickness direction of the first supporting member 10*c*. The first deformed portions 30*c* and 31*c*, in the first cut portions 10*a*1 and 10*a*2, protrude from the first fixed portions 30*a*1 and 31*a*1, and extend along two sides of the first cut portions 10*a*1 and 10*a*2 facing each other in the shorter direction M. Thus, the first supporting member 10*c* and the cleaning container 13 are positioned in the shorter direction M. Desirably, the first deformed portions 30*c* and 31*c* are formed to be shorter than the first cut portions 10*a*1 and 10*a*2 in the longitudinal direction N and are disposed apart from the longitudinal direction end surfaces of the first cut portions 10*a*1 and 10*a*2 by a predetermined distance W.

In this technical field, only a configuration in which a cleaning frame made of resin is locked with a cleaning blade sheet metal with small screws via a washer made of resin, has been employed. However, in the configuration, the cleaning frame and the cleaning blade sheet metal behave differently due to the difference between the cleaning frame and the cleaning blade sheet metal in thermal deformation at the engaged portions where the small screws are engaged. Therefore, to address this problem, slide amounts of the resin cleaning frame and the cleaning blade sheet metal may be increased so that the thermal deformation can be more compensated. However, this causes another problem that the cleaning blade is less accurately positioned with respect to the photosensitive drum. As described above, it has been difficult to make the cleaning blade come into contact with the photosensitive drum with uniform pressure in the longitudinal direction, to prevent insufficient removal (unsatisfactory cleaning) of the remaining toner on the photosensitive drum, and at the same time to decrease influence of heat in an apparatus constituted by a smaller number of parts.

Similarly, also in the developer blade that maintains a constant thickness of the toner on the developing roller, it has been difficult to come into contact with the developing roller with uniform pressure in the longitudinal direction, and at the same time to decrease influence of heat in an apparatus constituted by only a small number of parts.

In view of this, according to the configuration of the present exemplary embodiment, movement between the first supporting member 10*c* and the cleaning container 13 in the shorter direction M is restricted, but the movement therebetween in the longitudinal direction N is allowed. Thus, the configuration which decreases influence of heat in an apparatus constituted only by a small number of parts can be achieved without increasing the number of parts. Furthermore, the photosensitive drum 7 fixed to the cleaning container 13 can come into contact with the cleaning blade 10*a* fixed to the first supporting member 10*c* with uniform pressure in the longitudinal direction N. Generally, metal has a smaller linear expansion coefficient (thermal expansion coefficient) as an amount of expansion when receiving heat, than resin. More specifically, the thermal expansion coefficient of a galvanized steel plate used as the first supporting member 10*c*, is 0.000015<1/° C.>. On the other hand, the thermal expansion coefficient of high-impact polystyrene (HIPS) used as the cleaning container 13, is 0.000087<1/° C.>. Thus, there is a large difference between the thermal expansion coefficients. Accordingly, in conventional cases, the process cartridge B deforms due to the difference of the linear expansion coefficient (thermal expansion coefficient) between the members forming the supporting member 10*c* and the cleaning container 13, when the first supporting member 10*c* and the cleaning container 13 are fixed to each other at two points in the longitudinal direction N. More specifically, when the temperature rises more than the normal temperature, the side of the cleaning container 13 bulges. When the temperature drops from the normal temperature, the side of the first supporting member 10*c* bulges. According to the present exemplary embodiment, the first deformed portions 30*c* and 31*c* are disposed along two sides of the first cut portions 10*a*1 and 10*a*2 facing each other in the shorter direction M. Thus, the movement between the first supporting member 10*c* and the cleaning container 13 in the shorter direction M is restricted, but the movement therebetween in the longitudinal direction N is allowed, whereby the deformation of the process cartridge B can be prevented. As a result, the photosensitive drum 7 fixed to the cleaning container 13 can surely come into contact with the cleaning blade 10*a* fixed to the first supporting member 10*c*, with uniform pressure in the longitudinal direction N, regardless of the temperature.

Figure 4:
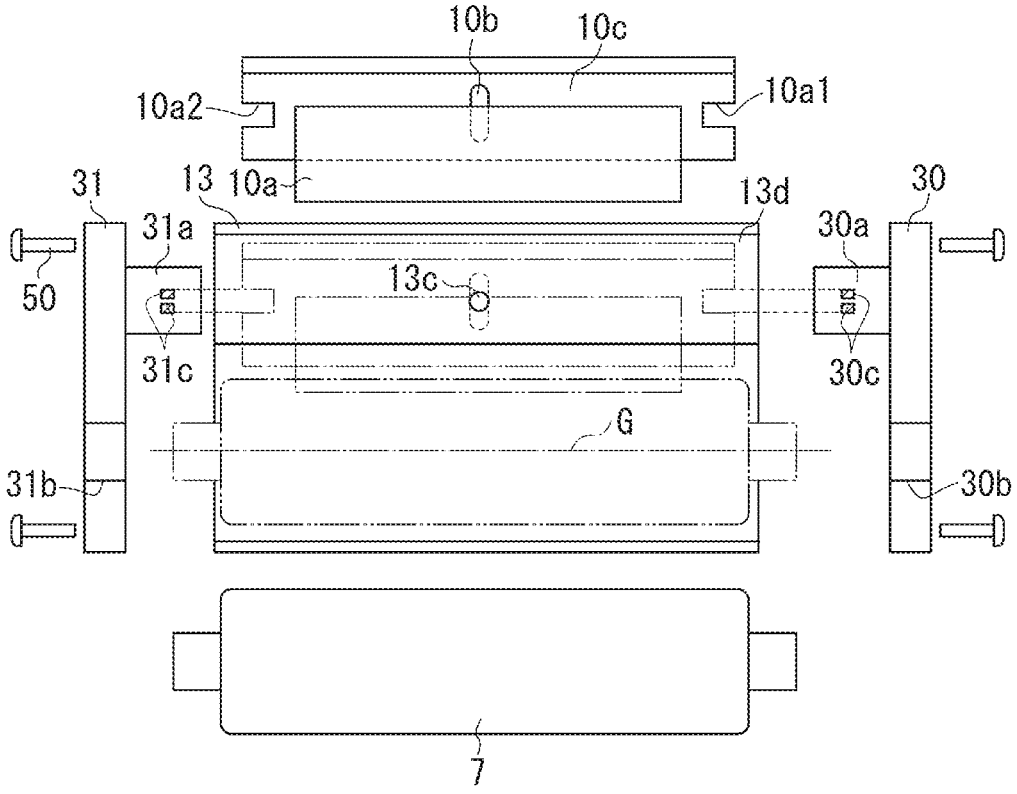
FIG. 4 is a diagram illustrating a method for recycling the cartridge according to the first exemplary embodiment.

In the configuration according to the present exemplary embodiment, the first supporting member 10*c* is not screwed or adhered onto the cleaning container 13. The first cut portions 10*a*1 and 10*a*2 formed on the first supporting portion 10*c*, have the shape that opens toward the end surfaces in the longitudinal direction N. As a result, recycling can be easily carried out. More specifically, as illustrated in FIG. 4, the screws 50 are first removed, and the first bearing members 30 and 31 are detached from the cleaning container 13 in the longitudinal direction N. Thus, the photosensitive drum 7, the first bearing members 30 and 31, and the cleaning blade 10*a* positioned with the first fixed portions 30*a*1 and 31*a*1 can be easily disassembled. More specifically, the first supporting member 10*c* is not positioned with respect to the cleaning container 13 in the longitudinal direction N, and thus the first bearing members 30 and 31 can be easily detached from the cleaning container 13. As described above, with the configuration of the present exemplary embodiment, the first supporting member 10*c* and the cleaning container 13 can be positioned easily, and can be disassembled easily. Accordingly, a configuration allowing for easy manufacturing and recycling can be achieved.

Furthermore, the first supporting member 10*c* is fixed by sandwiching between the cleaning container 13 and the first fixed portions 30*a* and 31*a*. Thus, an assembling process in integrating the photosensitive drum 7, the charging roller 8, the cleaning blade 10*a*, and the cleaning container 13 that are temporarily attached can be easily performed. As a result, in a conventional assembling process, the members need not to be assembled with high positional accuracy based on the size accuracy of the members. Thus, the first supporting member 10*c* and the cleaning container 13 can be more easily disposed with high positional accuracy.

<Method for Manufacturing Cleaning Unit>

Figure 5:
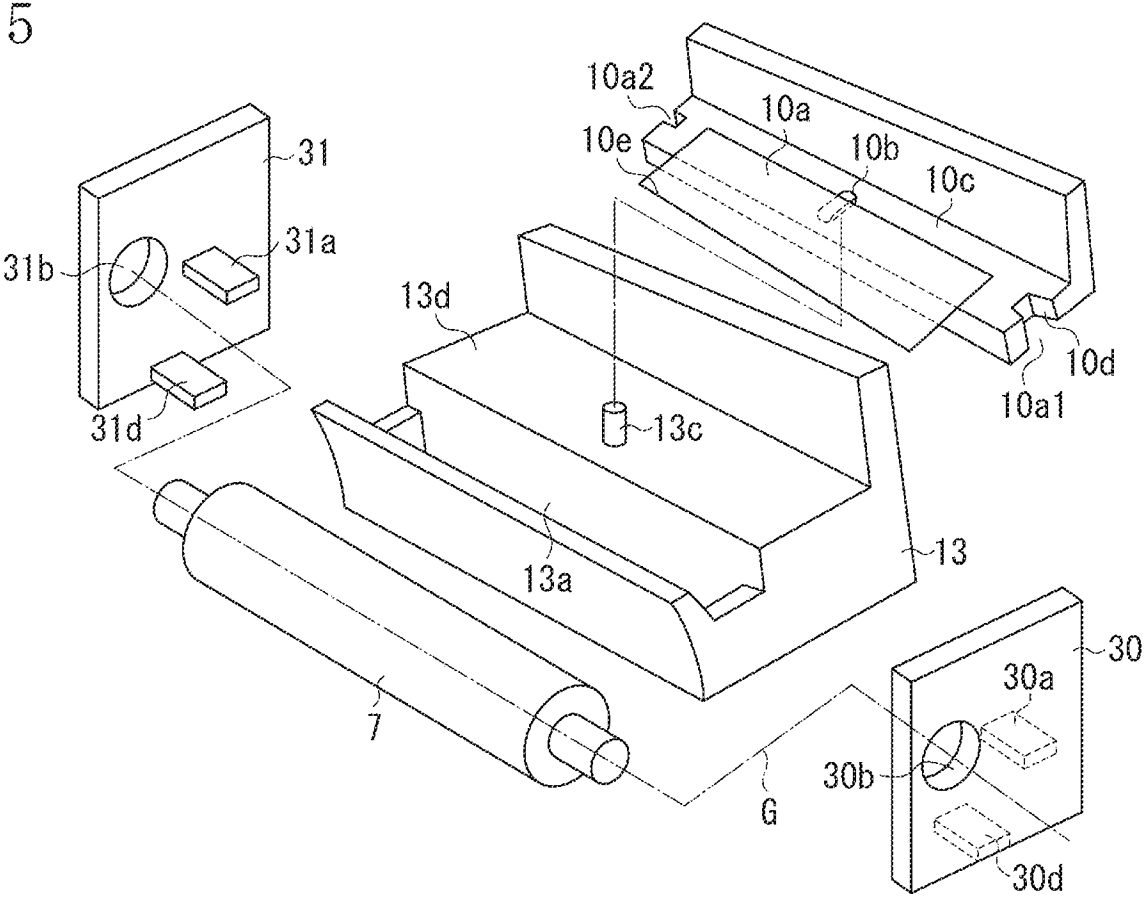
FIG. 5 is a diagram illustrating how members of the cartridge according to the first exemplary embodiment are assembled.

A method for manufacturing the cleaning unit C described above, is described below with reference to FIG. 5 and FIG. 6. FIG. 5 illustrates how the members are assembled. FIG. 6 is a cross-sectional view of a portion around the first supporting member 10*c* taken along the longitudinal direction N. The figure illustrates a state where the cleaning container 13, the cleaning blade 10*a* integrated with the first supporting member 10*c*, the photosensitive drum 7, and the first bearing members 30 and 31 are assembled to be integrated.

First of all, the cleaning container 13 as a frame body and the first supporting member 10*c* having one end in the shorter direction M which is fixed to the cleaning blade 10*a* along the longitudinal direction N are prepared. The first engagement portion 10*b* of the first supporting member 10*c* engages with the first engaged portion 13*c* of the cleaning container 13. The first supporting member 10*c* is disposed on the first placing surface 13*d* of the cleaning container 13. Thus, the first supporting member 10*c* is positioned with respect to the cleaning container 13 in the longitudinal direction N. More specifically, the first engagement portion 10*b* that has an elongated hole shape and is recessed, engages with the first engaged portion 13*c* protruding toward the first supporting member 10*c*, that is, the fixing member. Here, the first supporting member 10*c* is disposed in such a manner that a distal end 10*e* of the cleaning blade 10*a* is positioned above an opening of the waste toner chamber 13*a* of the cleaning container 13. The shaft of the photosensitive drum 7 engages with the first bearings 30*b* and 31*b* of the first bearing members 30 and 31. The first bearing members 30 and 31 are disposed at both ends of the cleaning container 13 in the longitudinal direction N, in such a manner that the first fixed portions 30*a* and 31*a* cover the first cut portions 10*a*1 and 10*a*2. Here, the photosensitive drum 7 is held in a state where a rotational shaft G of the photosensitive drum 7 is positioned at an appropriate position. The first bearing members 30 and 31 are fastened and thus fixed to the cleaning container 13 with the screws 50. When the photosensitive drum 7, the first bearing members 30 and 31, and the first supporting member 10*c* are disposed on the cleaning container 13, the first supporting member 10*c* can be formed such that the first supporting member 10*c* is sandwiched between the first placing surface 13*d* and the first fixed portions 30*a* and 31*a*. Here, desirably, first reinforcement portions 30*d* and 31*d* are provided to the first bearing members 30 and 31, and the cleaning container 13 and the first supporting member 10*c* are press fit and sandwiched between the first fixed portions 30*a* and 31*a* and the first reinforcement portions 30*d* and 31*d*.

Figure 6A:
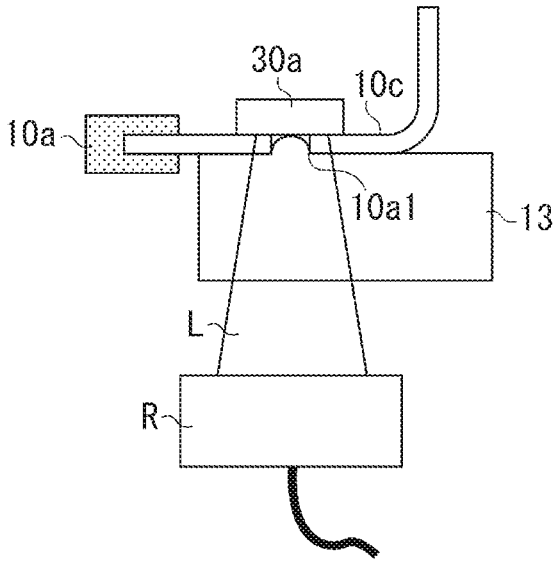
FIGS. 6A and 6B are diagrams illustrating a method for manufacturing the cartridge according to the first exemplary embodiment.
Figure 6B:
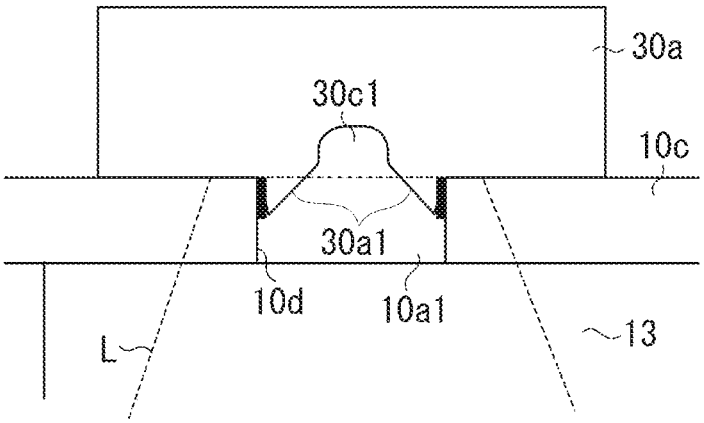

As illustrated in FIG. 6A, a laser beam irradiated portion 30*c*1 of the first fixed portions 30*a* is irradiated with a laser beam L from a laser oscillator R through spaces in the cleaning container 13 and the first cut portion 10*a*1. As a result, the resin forming the first fixed portions 30*a* is deformed by the laser beam L, whereby the first deformed portion 30*c* is formed. The first deformed portion 30*c* engages with the first cut portion 10*a*1, whereby the first supporting member 10*c* and the cleaning container 13 are positioned in the shorter direction M. A description is further given with reference to FIG. 6B. The first fixed portion 30*a* exposed through the first cut portion 10*a*1 is irradiated with the laser beam L. Thus, the resin at a portion irradiated with the laser beam L melts and the laser beam irradiated portion 30*c*1 is recessed. As a result, the first deformed portion 30*c*, protruding in such a manner as to surround the laser beam irradiated portion 30*c*1, is formed. According to the present exemplary embodiment, the resin melts to deform in such a manner to come into contact with the inner wall surface 10*d* of the first cut portion 10*a*1 extending in the thickness direction of the first supporting portion 10*c*. Thus, the first deformed portion 30*c* that has a tapered cross-sectional shape and protrudes along the longitudinal direction N of the first cut portions 10*a*1 and 10*a*2 is formed. Accordingly, the movement of the first supporting member 10*c* with respect to the cleaning container 13 in the shorter direction M is restricted. The first supporting member 10*c* made of metal with high thermal conductivity, is disposed adjacent to the laser beam irradiated portion 30*c*1 and thus absorbs heat. As a result, an abnormally sharp rise in the temperature at a portion that has absorbed the laser beam L is prevented, and the material of the laser beam irradiated portion 30*c*1 can melt and deform without decomposing, whereby formation of the first deformed portion 30*c* is facilitated. Similarly, a laser beam irradiated portion 31*c*1 of the first fixed portion 31*a* is irradiated with the laser beam L through spaces in the cleaning container 13 and the first cut portion 10*a*2. Thus, the first deformed portion 31*c* is formed. Then, the first deformed portion 31*c* is engaged with the first cut portion 10*a*2, whereby the first supporting member 10*c* and the cleaning container 13 are positioned in the shorter direction M.

According to the present exemplary embodiment, the cleaning container 13 may be made of any material that can transmit the laser beam L. For example, a styrene resin compound at least including styrene resin as base resin and rubber-like polymer can be used. The styrene resin in the styrene-resin compound includes polystyrene and acrylonitrile butadiene styrene (ABS). It is desirable that polystyrene is used. The rubber-like polymer in the styrene resin compound includes poly butadiene, styrene-butadiene copolymer, polyisoprene, butadiene-isoprene copolymer, natural rubber, ethylene-propylene copolymer, and the combination of these. In particular, high styrene-butadiene copolymer is used as the rubber-like copolymer in the styrene resin compound. The styrene resin compound including the styrene resin and the rubber-like polymer may be referred to as HIPS as a rubber modified styrene material. HIPS is a resin compound with high shock resistance, which is obtained by mixing rubber-like copolymer (including the rubber-like polymer) in polystyrene (PS) that is inexpensive and has high flowability, and thus is desirably used herein. Therefore, HIPS is used as the cleaning container 13 in the present exemplary embodiment.

On the other hand, the first fixed portions 30*a* and 31*a* of the first bearing members 30 and 31 may be made of any material that can be heated and deformed by absorbing the laser beam L. For example, a material may be used which is obtained by dispersing a material that absorbs the laser beam L in the styrene resin compound at least including styrene resin as base resin and the rubber-like polymer. The styrene resin transmits the laser beam L. It is desirable that resin that transmits the laser beam L is obtained by dispersing carbon black and the like in plastic that thermally deforms. In the present exemplary embodiment, a material obtained by dispersing carbon black in HIPS is used as the first fixed portions 30*a* and 31*a* of the first bearing members 30 and 31.

When a pigment such as carbon black is dispersed in the thermally deformed resin material, the pigment such as carbon black may not be dispersed over the entire area of the first bearing members 30 and 31. Instead, the pigment such as carbon black may be dispersed only in the first fixed portions 30*a* and 31*a*.

The wavelength of the laser beam L can be in a near-infrared region (750 to 3000 nm). It is desirable that the output of the laser beam L is 100 W or lower. According to the present exemplary embodiment, a semiconductor laser with the following specification is used: a laser spot diameter: 0.6 mm, a diameter of the laser beam L radiated on a joint portion: 1.2 mm, wavelength 940 nm, and output 50 W. Other alternatives such as glass laser, Nd:YAG laser, ruby laser, He—Ne laser, krypton laser, Ar laser, $H_2$ laser, and $N_2$ laser can also be used. However, use of the semiconductor laser is desirable.

With the configuration according to the exemplary embodiment described above, the first supporting member 10*c* and the cleaning container 13 can be fixed easily and with high positional accuracy, without increasing the number of parts. More specifically, the first supporting member 10*c* can be fixed to the cleaning container 13 by radiating the laser beam L, applying heat, and applying energy, and without using a screw and the like. The first supporting member 10*c* and the cleaning container 13 can be positioned after the assembling process of integrating the first supporting member 10*c* to which the photosensitive drum 7, the charging roller 8, and the cleaning blade 10*a* are fixed with the cleaning container 13. As a result, the assembling process can be performed easily without high positional accuracy based on the size accuracy of each member. Furthermore, after the assembling process, the photosensitive drum 7 fixed to the cleaning container 13 and the cleaning blade 10*a* fixed to the first supporting member 10*c* can be fixed after having adjusted their positions. Thus, the assembling can be performed with high positional accuracy. The first supporting member 10*c* is not screwed or adhered onto the cleaning container 13, and the first deformed portions 30*c* and 31*c* are formed and fixed by radiating the laser beam L. Accordingly, the first bearing members 30 and 31 can be easily detached from the cleaning container 13. Accordingly, the configuration allowing for easy manufacturing and recycling can be achieved with the present exemplary embodiment.

A second exemplary embodiment of the present invention is described below. In the first exemplary embodiment, the case is described where the present invention is applied to the configuration of fixing the supporting member that supports the cleaning blade in the cleaning unit. In the second exemplary embodiment, a case is described where the present invention is applied to a configuration of fixing the developer blade in the developing unit. The overall configuration of the image forming apparatus and the overall schematic configuration of the cartridge are similar between the second exemplary embodiment and the first exemplary embodiment. Thus, the difference from the first exemplary embodiment is mainly described below.

<Detailed Description of Developing Unit>

The developing unit D includes the developing roller 9*c* that can rotate while being in contact with the photosensitive drum 7, the developer blade 9*d* for regulating the thickness of the toner layer on the developing roller 9*c*, and the developer container 12 as a frame body that supports the developing roller 25. The blowout prevention sheet 12*b* that comes into contact with the developing roller 9*c* is provided to the developer container 12, so that the toner can be prevented from leaking from the developer container 12. The developing unit D is fixed to the cleaning unit C in such a manner that the developing roller 9*c* and the photosensitive drum 7 face each other. The toner container 11 that stores the toner supplied to the developer container 12 is connected to the developing unit D, whereby the developer unit T is formed.

The developer container 12 has a second placing surface adjacent to the opening of the developer container 12, as in the case of the first placing surface 13*d* of the cleaning container 13. The second supporting member 9*a* is provided with a second engagement portion and second cut portions, as in the case of the first engagement portion 10*b* of the first supporting member 10*c*. The second cut portions are disposed on both ends of the second supporting member 9*a* in the longitudinal direction N and have two parallel sides along the longitudinal direction N. Each of the second cut portion has a shape that extends in the longitudinal direction N. The second engagement portion has two parallel sides, along the shorter direction M crossing the longitudinal direction N, substantially at the center of the second supporting member 9*a* in the longitudinal direction N. The second engagement portion has a shape that extends in the shorter direction M. The second supporting member 9*a* is placed on the second placing surface of the developer container 12 in an engaged state where the second engaged portion which is provided in the second placing surface is inserted in the second engagement portion. Thus, the second supporting member 9*a* and the developer container 12 are positioned in the longitudinal direction N. The second engagement portion may be an elongated hole, or may be an opening at one end in the shorter direction M, which does not face the developing roller 9*c*. According to the present exemplary embodiment, a configuration is employed where the second engaged portion as a protrusion and the second engagement portion as a recess are used. However, the configuration is not limited thereto. Any configuration can be employed as long as the positioning in the longitudinal direction N can be achieved by the second engaged portion and the second engagement portion. For example, the second engaged portion as a recess and the second engagement portion as a protrusion may be used. The developer blade 9*d* is fixed to the second supporting member 9*a* in such a manner as to extend from one end in the shorter direction M, which faces the opening toward the rotating body, that is, the developing roller 9*c*, along the longitudinal direction N. The developer blade 9*d* and the second supporting member 9*a* are integrally formed by molding or welding.

Second bearing members, including second fixed portions 40*a* and second bearings, are fixed to ends of the developer container 12 in the longitudinal direction N, with screws. Thus, a shaft of the developing roller 9*c* is supported by the second bearings in such a manner as to come into contact with the developing blade 9*d* above the opening of the developer container 12. The second fixed portion 40*a* is disposed to cover the second cut portion of the second supporting member 9*a*. More specifically, the second supporting member 9*a* is fixed by sandwiching between the developer container 12 and the second fixed portion 40*a*. The second fixed portion 40*a* includes a second deformed portion formed in the second cut portion of the second supporting member 9*a*. It is desirable that at least one second deformed portion is disposed to be in contact with both of two parallel sides of the second cut portion along the longitudinal direction N of the second supporting member 9*a*. Thus, the second deformed portion having a tapered cross-sectional shape is formed so as to come into contact with inner wall surfaces of the second cut portion extending in the thickness direction of the second supporting member 9*a*. As described above, the second deformed portion that protrudes from the second fixed portion 40*a* and extends along the two sides of the second cut portion that face each other in the shorter direction M of the second cut portion is disposed in the second cut portion. Thus, the second supporting member 9*a* and the developer container 12 are positioned in the shorter direction M. It is desirable that the second deformed portion is shorter than the second cut portion in the longitudinal direction N, and is disposed while being apart from a longitudinal end surface of the second cut portion by a predetermined distance.

In the configuration described above, the movement between the second supporting member 9*a* and the developer container 13 in the shorter direction M is restricted but the movement therebetween in the longitudinal direction N is allowed, as in the configuration in which the first supporting member 10*c* is disposed in the cleaning unit C. As a result, a configuration that is less likely to be affected by heat, with a small number of parts can be achieved without increasing the number of parts. Furthermore, the developing roller 9*c* fixed to the developer container 12 can come into contact with the developer blade 9*d* fixed to the second supporting member 9*a* with uniform pressure in the longitudinal direction N.

In the configuration according to the present exemplary embodiment, the second supporting member 9*a* is not screwed or adhered onto the developer container 12. The second cut portion has a shape that opens toward the end surface in the longitudinal direction N, whereby an easily recycled configuration can be achieved. As described above, with the configuration of the present exemplary embodiment, the second supporting member 9*a* and the developer container 12 can be positioned easily, and can be disassembled easily. Accordingly, a configuration allowing for easy manufacturing and recycling can be achieved.

Furthermore, the second supporting member 9*a* is fixed by sandwiching between the developer container 12 and the second fixed portion 40*a*. Thus, an assembling process of integrating the developing roller 9*c*, the second supporting member 9*a* to which the developer blade 9*c* is fixed, and the developer container 12 that are temporarily attached can be easily performed. As a result, in a conventional assembling process, the members need not to be assembled with high positional accuracy based on the size accuracy of the members. Thus, the second supporting member 9*a* and the developer container 12 can be more easily arranged with high positional accuracy.

<Method for Manufacturing Developing Unit>

A method for manufacturing the above developing unit D is described below. As in the configuration of the first exemplary embodiment where the first supporting member 10*c* is disposed and the cleaning unit C is formed, first, the developer container 12 as the frame body and the second supporting member 9*a* having one shorter direction end fixed to the developer blade 9*d* along the longitudinal direction N are prepared. The second supporting member 9*a* is placed on the second placing surface of the developer container 12 with the second engagement portion of the second supporting member 9*a* engaging with the second engaged portion of the developer container 12. Thus, the second supporting member 9*a* is positioned with respect to the developer container 12 in the longitudinal direction N. More specifically, the second engagement portion that has an elongated hole shape and is recessed, engages with the second engaged portion protruding toward the second supporting member 9*a*, that is, the fixing member. The second supporting member 9*a* is disposed in such a manner that a distal end of the developer blade 9*d* is positioned above the opening of the developer container 12. The shaft of the developing roller 9*c* engages with second bearings of the second bearing member. The second bearing members are disposed at both ends of the developer container 12 in the longitudinal direction N, in such a manner that the second fixed portion 40*a* of the second bearing member covers the second cut portion of the second supporting member 9*a*. Here, the developing roller 9*c* is held in a state where a rotational shaft is positioned at an appropriate position. The second bearing members are fastened and thus fixed to the developer container 12 with screws. When the developing roller 9*c*, the second bearing member, and the second supporting member 9*a* are disposed on the developer container 12, it is desirable that the second supporting member 9*a* is sandwiched between the second placing surface of the developer container 12 and the second fixed portion 40*a* of the second bearing member. It is desirable that second reinforcement portions are provided to the second bearing members, and the developer container 12 and the second supporting member 9*a* are press fit and sandwiched between the second fixed portion 40*a* of the second bearing member and the second reinforcement portions.

After the developer container 12, the developer blade 9*d* integral with the second supporting member 9*a*, the developing roller 9*c*, and the second bearing member are assembled to be integrated, a laser beam irradiated portion of the second fixed portion 40*a* is irradiated with the laser beam through spaces in the developer container 12 and the second cut portion. As a result, the resin forming the second fixed portions 40*a* is deformed by the laser beam L, whereby the second deformed portion is formed. Thus, the second supporting member 9*a* and the developer container 12 are positioned in the shorter direction M. More specifically, the second fixed portion 40*a* exposed through the second cut portion is irradiated with the laser beam. Thus, a portion irradiated with the laser beam melts and the laser beam irradiated portion is recessed. As a result, the second deformed portion is formed, protruding in such a way as to surround the laser beam irradiated portion. In the present exemplary embodiment, the resin melts and deforms in such a way as to be in contact with the inner wall surface of the second cut portion extending in the thickness direction of the second supporting member 9*a*. Thus, the second deformed portion that has a tapered cross-sectional shape and protrudes along the longitudinal direction N of the second cut portion is formed. Thus, the movement of the second supporting member 9*a* with respect to the developer container 12 in the shorter direction M is restricted. The developer container 12 and the cleaning container 13 according to the first exemplary embodiment are formed of the similar material. The second fixed portion 40*a* and the first fixed portions 30*a* according to the first exemplary embodiment are formed of the similar material. The developing unit D according to the second exemplary embodiment is formed under the laser condition described in the first exemplary embodiment.

In the configuration according to the present exemplary embodiment, as in the configuration in the first exemplary embodiment in which the first supporting member 10*c* is disposed and the cleaning unit C is formed, the second supporting member 9*a* and the developer container 12 can be fixed easily and with high positional accuracy, without increasing the number of parts. The second supporting member 9*a* and the developer container 12 can be positioned after the assembling process in which the developing roller 9*c*, the second supporting member 9*a* to which the developer blade 9*d* is fixed, and the developer container 12 are integrated. As a result, the assembling process can be performed easily without high positional accuracy based on the size accuracy of the members. Furthermore, after the assembling process, the developing roller 9*c* fixed to the developer container 12 and the developer blade 9*d* fixed to the second supporting member 9*a* can be fixed after having adjusted their positions. Thus, the assembling can be performed with high positional accuracy. The second supporting member 9*a* is not screwed or adhered onto the developer container 12, and the second deformed portion is formed and fixed by radiating the laser beam. As a result, recycling can be easily carried out.

In the exemplary embodiments described above, the first supporting member 10*c* to which the cleaning blade 10*a* is fixed and the second supporting member 9*a* to which the developer blade 9*d* is fixed are used. However, the exemplary embodiments should not be limiting. For example, the cleaning blade 10*a* integrated with the first supporting member 10*c* and the developer blade 9*d* integrated with the second supporting member 9*a* may be used. As a fixed portion in the exemplary embodiments, a separately provided fixing member that is directly or indirectly fixed to the bearing member and the cleaning container or the developer container may be used. When the separately formed fixing member is used, the first supporting member may be fixed in such a way as to be movable between the cleaning container and the fixing member in the longitudinal direction. The second supporting member 9*a* may be fixed in such a way as to be movable between the developer container 12 and the fixing member in the longitudinal direction.

Furthermore, in the exemplary embodiments described above, the deformed portion is formed by radiating the laser beam. However, this should not be limited to the configuration. Other energy such as heat may be used as long as the resin can be deformed. In such a case, the deformed portion may be formed by pressing a hot iron against the fixed portion exposed from the inside of the engagement portion.

Figure 7:
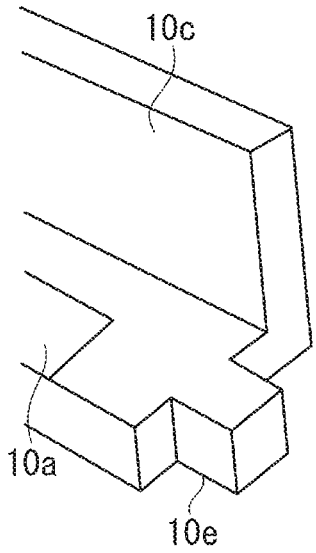
FIG. 7 is a partial cross-sectional view of cartridge according to a modification of the present invention.

In the first exemplary embodiment, the first cut portions 10*a*1 and 10*a*2 have a shape that opens toward the end surfaces in the longitudinal direction N as illustrated in FIG. 1. However, this should not be limited to the configuration. The cut portion that can be applied to the first and the second exemplary embodiments may have any shape that has two parallel sides along the longitudinal direction N and extends in the longitudinal direction N. For example, a rectangular shape, an elongated hole shape, or a shape obtained by cutting out the both end portions of the first or the second supporting member leaving only the center portion in the shorter direction M, may be used instead of the first cut portions 10*a*1 and 10*a*2 illustrated in FIG. 1. As illustrated in FIG. 7, when a first cut portion 10*e* having a shape obtained by cutting out both end portions of the first supporting member leaving only the center portion in the shorter direction M is used, the movement in the shorter direction M may be restricted by providing the first deformed portions along both ends in the shorter direction M of the first cut portion 10*e*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-107445, filed May 23, 2014, which is hereby incorporated by reference herein in its entirety.

What is claimed is:

1. A cartridge comprising:

a rotating body;

a blade that extends in an axial direction of the rotating body and is disposed on the rotating body;

a supporting member that is fixed to the blade and configured to support the blade in such a manner that the blade protrudes toward the rotating body in a shorter direction crossing the axial direction;

a frame body including a placing surface that supports the supporting member; and a fixed portion that is disposed on the placing surface via the supporting member and fixed to the frame body, wherein the supporting member includes a cut portion extending in the axial direction, wherein the fixed portion includes a deformed portion deformed by given energy, and wherein the deformed portion engages with the cut portion so that movement of the supporting member with respect to the frame body is restricted.

2. The cartridge according to claim 1, further comprising a bearing member that is integrally formed with the fixed portion and configured to support a shaft of the rotating body.

3. The cartridge according to claim 1, wherein the deformed portion is shorter than the cut portion in the axial direction.

4. The cartridge according to claim 1, wherein the deformed portion is disposed along two sides of the cut portion that face each other in the shorter direction.

5. The cartridge according to claim 1, wherein the supporting member further includes an engagement portion, wherein the frame body includes an engaged portion on the placing surface, and wherein the engagement portion and the engaged portion are engaged so that the fixed portion is positioned with respect to the frame body in the axial direction.

6. The cartridge according to claim 5, wherein one of the engagement portion and the engaged portion is a protrusion, and the other one of the engagement portion and the engaged portion is a recess shorter than the protrusion in the shorter direction.

7. The cartridge according to claim 1, wherein the rotating body is a developer bearing member, and wherein the blade is a developer blade configured to regulate a thickness of developer on the developer bearing member.

8. The cartridge according to claim 1, wherein the rotating body is a photosensitive drum, and wherein the blade is a cleaning blade configured to remove developer from a surface of the photosensitive drum.

9. A method for manufacturing a cartridge including a rotating body, a blade that extends in an axial direction of the rotating body and is disposed on the rotating body, a supporting member that is fixed to the blade and configured to support the blade in such a manner that the blade protrudes toward the rotating body in a shorter direction crossing the axial direction, a frame body including a placing surface that supports the supporting member, and a fixed portion that is disposed on the placing surface via the supporting member and fixed to the frame body, the method comprising:

a first step of fixing the fixed portion to the frame body by disposing the fixed portion on the supporting member; and a second step of forming a deformed portion by applying energy to the fixed portion after the first step, so that the fixed portion is deformed, and engaging the deformed portion with a cut portion which is included in the supporting member and extending in the axial direction so that movement of the supporting member with respect to the frame body is restricted.

10. The method for manufacturing the cartridge according to claim 9, wherein the deformed portion is formed by applying the energy to the fixed portion with laser.

11. The method for manufacturing the cartridge according to claim 9, wherein the deformed portion is formed by applying heat to the fixed portion.

12. The method for manufacturing the cartridge according to claim 9, wherein the fixed portion is integrally formed with a bearing member configured to support a shaft of the rotating body, restricts movement of the supporting member between the fixed portion and the bearing member, and supports the shaft of the rotating body.

13. The method for manufacturing the cartridge according to claim 9, wherein the deformed portion is shorter than the cut portion in the axial direction.

14. The method for manufacturing the cartridge according to claim 9, wherein the deformed portion is disposed along two sides of the cut portion that face each other in the shorter direction.

15. The method for manufacturing the cartridge according to claim 9, further comprising:

positioning the fixed portion with respect to the frame body in the axial direction by disposing the supporting member on the placing surface of the frame body and engaging an engaged portion disposed on the placing surface of the frame body with an engagement portion of the supporting member, before the first step.

16. The method for manufacturing the cartridge according to claim 9, wherein one of the engagement portion and the engaged portion is a protrusion, and the other one of the engagement portion and the engaged portion is a recess shorter than the protrusion in the shorter direction.

17. The method for manufacturing the cartridge according to claim 9, wherein the rotating body is a developer bearing member, and wherein the blade is a developer blade configured to regulate a thickness of developer on the developer bearing member.

18. The method for manufacturing the cartridge according to claim 9, wherein the rotating body is a photosensitive drum, and wherein the blade is a cleaning blade configured to remove developer from a surface of the photosensitive drum.

* * * * *